US006892961B1

(12) United States Patent
Fuellenbach

(10) Patent No.: US 6,892,961 B1
(45) Date of Patent: May 17, 2005

(54) PLURAL COMPONENT MATERIAL MIXER

(75) Inventor: Arnd Fuellenbach, Willich (DE)

(73) Assignee: Graco Minnesota Inc., Minneapolis, MN (US)

( * ) Notice: Subject to any disclaimer, the term of this patent is extended or adjusted under 35 U.S.C. 154(b) by 177 days.

(21) Appl. No.: 10/069,311

(22) PCT Filed: Sep. 14, 2000

(86) PCT No.: PCT/US00/25174

§ 371 (c)(1),
(2), (4) Date: Feb. 20, 2002

(87) PCT Pub. No.: WO01/19526

PCT Pub. Date: Mar. 22, 2001

Related U.S. Application Data

(60) Provisional application No. 60/154,252, filed on Sep. 16, 1999.

(51) Int. Cl.[7] ..... B05B 7/10

(52) U.S. Cl. ..... 239/399; 239/401; 239/407; 222/145.6; 222/135

(58) Field of Search ..... 239/407, 413, 239/408, 399, 401; 222/145.5, 145.6, 135, 137

(56) References Cited

U.S. PATENT DOCUMENTS 5,328,093 A * 7/1994 Feitel ..... 239/3
5,407,267 A * 4/1995 Davis et al. ..... 239/410
5,490,726 A * 2/1996 Davis et al. ..... 222/57

* cited by examiner

*Primary Examiner*—Dinh Q. Nguyen
(74) *Attorney, Agent, or Firm*—Douglas B. Farrow

(57) ABSTRACT

A conventional airless tip (18) is located in line in the fluid line (20) immediately down stream of the static mixer (16) in a plural components metering and mixing system (12). A pressure drip of 10–30 bar across the spray tip (18) provides enhanced mixing for aqueous and other hard-to-mix plural component materials.

1 Claim, 1 Drawing Sheet

PLURAL COMPONENT MATERIAL MIXER

This application claims the benefit of provisional application Ser. No. 60/154,252 filed on Sep. 16, 1999.

TECHNICAL FIELD

Mixers for plural component materials such as epoxies and polyurethanes.

BACKGROUND ART

For environmental and finish quality reasons, plural component paints and other materials have become increasing popular in recent years. Various manufacturers produce equipment for metering and mixing the plural components for application to various substrates. More particularly the waterborne materials have presented a particular problem in terms of mixing and blending the materials. While devices such as Graco's PRECISIONMIX® plural component equipment have received a great deal of acceptance in the industry for mixing such materials, some have proven stubborn in achieving the final mix. A jet dispersion device produced by Bayer has proven capable of mixing such materials but is somewhat complicated and relatively difficult to flush.

DISCLOSURE OF THE INVENTION

It is therefore an object of this invention to produce a mixer which is capable of producing a homogeneously mixed material even out of hard-to-mix components. Towards that end, typical sequential metering devices such as the aforementioned PRECISIONMIX® utilize an integrator followed by a static mixer in order to perform the mixing. In the instant invention, the outlet of the static mixer is connected to a conventional airless tip located inline on the line to the spray gun or other application device. A tip size is utilized such that a pressure drop of 10–30 bar is maintained through the airless tip which will provide a suitable pressure drop. One example of this would be the use of a 0.8 mm tip in a 5 mm fluid line.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
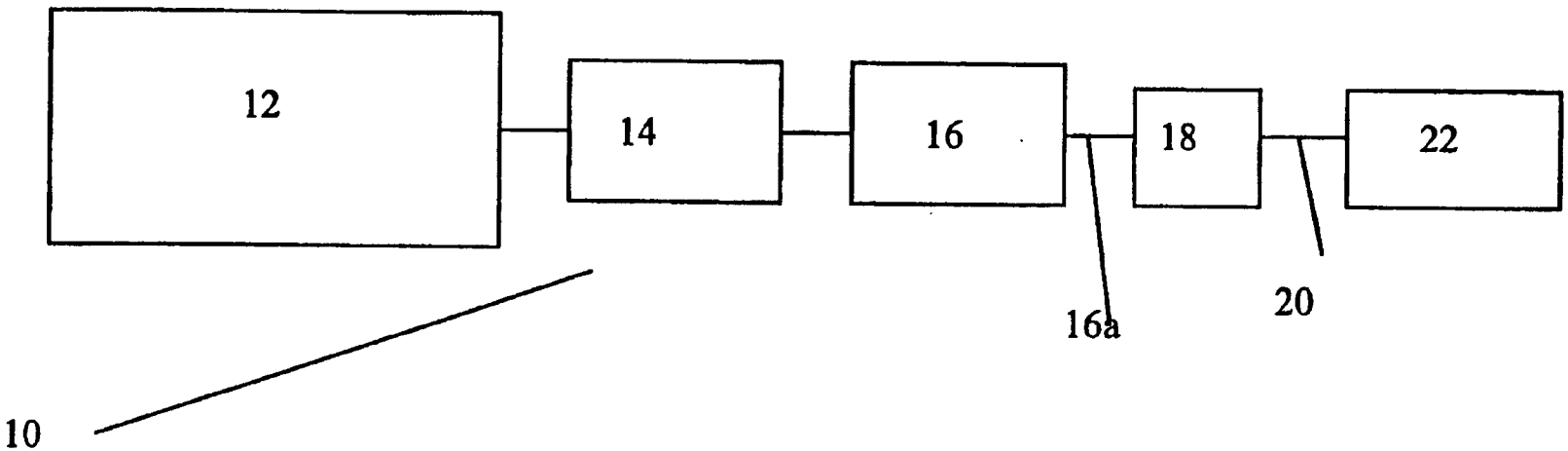
FIG. 1 is a schematic layout of the instant invention.

The instant invention generally designated 10 is comprised of a plural component mixing machine 12 having a integrator 14 followed by a static mixer 16. The outlet 16*a* of static mixer 16 is connected to a spray tip 18 which can be a conventional airless spray tip such as those manufactured by Graco Inc. or any number of other manufacturers. Airless spray tip 18 is in turn connected to a fluid line 20 which may be in turn connected to an application device 22 such as a spray gun or the like.

It is contemplated that various changes and modifications may be made to the plural component material mixer without departing from the spirit and scope of the invention as defined by the following claims.

What is claimed is:

1. In a plural component material mixer having a sequential metering unit, an integrator connected to the output of said metering unit, a static mixer connected to the output of said integrator and an application device connected to the output of said static mixer, the improvement comprising an airless tip connected between said static mixer and said application device, said airless tip being sized to produce a pressure drop across said airless tip of about ten to thirty bar.

* * * * *